US010468754B2

(12) United States Patent
Vanjani

(10) Patent No.: US 10,468,754 B2
(45) Date of Patent: Nov. 5, 2019

(54) BIFURCATED MULTI-MODE RING ANTENNA FOR A WIRELESS COMMUNICATION DEVICE

(71) Applicant: Futurewei Technologies, Inc., Plano, TX (US)

(72) Inventor: Kiran Vanjani, San Diego, CA (US)

(73) Assignee: FUTUREWEI TECHNOLOGIES, INC., Plano, TX (US)

( * ) Notice: Subject to any disclaimer, the term of this patent is extended or adjusted under 35 U.S.C. 154(b) by 1 day.

(21) Appl. No.: 15/835,150

(22) Filed: Dec. 7, 2017

(65) Prior Publication Data

US 2019/0181537 A1 Jun. 13, 2019

(51) Int. Cl.

| | |
|---|---|
| ***H01Q 7/00*** | (2006.01) |
| ***H01Q 1/24*** | (2006.01) |
| ***H01Q 5/30*** | (2015.01) |
| ***H01Q 13/10*** | (2006.01) |

(52) U.S. Cl.

CPC ..... *H01Q 1/243* (2013.01); *H01Q 5/30* (2015.01); *H01Q 7/00* (2013.01); *H01Q 13/10* (2013.01)

(58) Field of Classification Search

CPC ..... H01Q 1/243; H01Q 7/00; H01Q 5/30; H01Q 13/10

USPC ..... 343/700 MS, 725

See application file for complete search history.

(56) References Cited

U.S. PATENT DOCUMENTS

| | | | | |
|---|---|---|---|---|
| 7,183,983 | B2 * | 2/2007 | Ozden | H01Q 1/243 343/700 MS |
| 7,233,291 | B2 * | 6/2007 | Elkobi | H01Q 1/243 343/700 MS |
| 7,450,072 | B2 * | 11/2008 | Kim | H01Q 1/243 343/700 MS |
| 8,279,611 | B2 * | 10/2012 | Wong | H01P 3/121 361/749 |
| 8,786,507 | B2 * | 7/2014 | Ayatollahi | H01Q 1/38 343/725 |
| 9,462,096 | B2 * | 10/2016 | Han | H01Q 1/243 |
| 2014/0139379 | A1 | 5/2014 | Bolin et al. | |
| 2016/0191681 | A1 * | 6/2016 | Han | H01Q 1/243 455/575.7 |

FOREIGN PATENT DOCUMENTS

| | | | |
|---|---|---|---|
| CN | 103825086 | A | 5/2014 |
| CN | 104269606 | A | 1/2015 |
| CN | 105609969 | A | 5/2016 |
| EP | 2337150 | A1 | 6/2011 |

OTHER PUBLICATIONS

International Search Report dated Jan. 22, 2019, in PCT Application No. PCT/CN2018/116678, 9 pages.

* cited by examiner

*Primary Examiner* — Jean B Jeanglaude
(74) *Attorney, Agent, or Firm* — Vierra Magen Marcus LLP

(57) ABSTRACT

The present technology relates to a multiband antenna for wireless mobile communication devices such as cellular telephones. The antenna may include a bifurcated ring structure along one, two, three or all four edges of the device. The ring structure may include bifurcated metal conductors, or bars, extending along the length of the one or more edges.

35 Claims, 7 Drawing Sheets

Fig. 6A
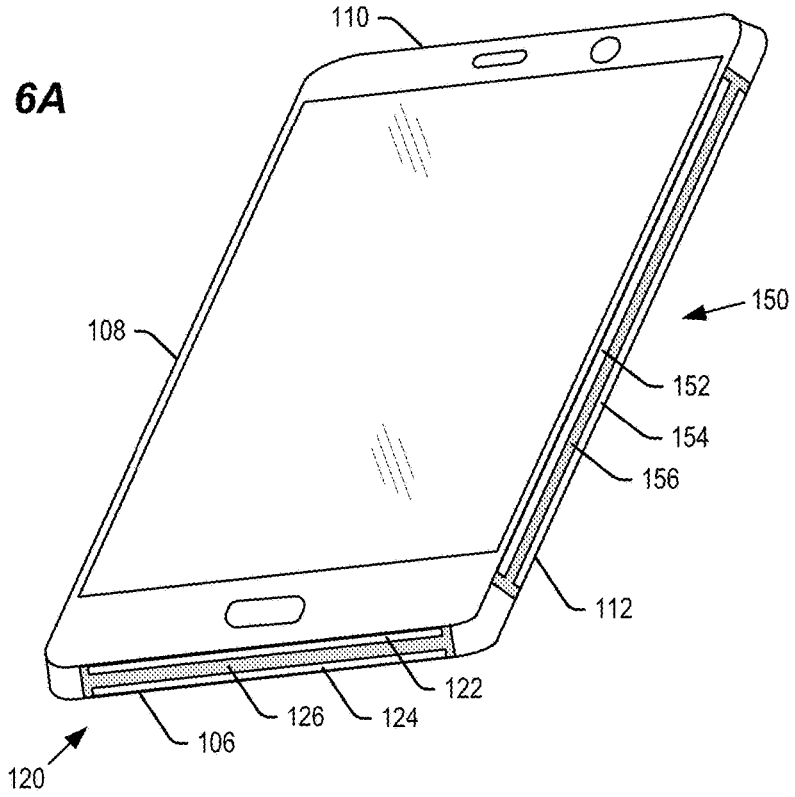
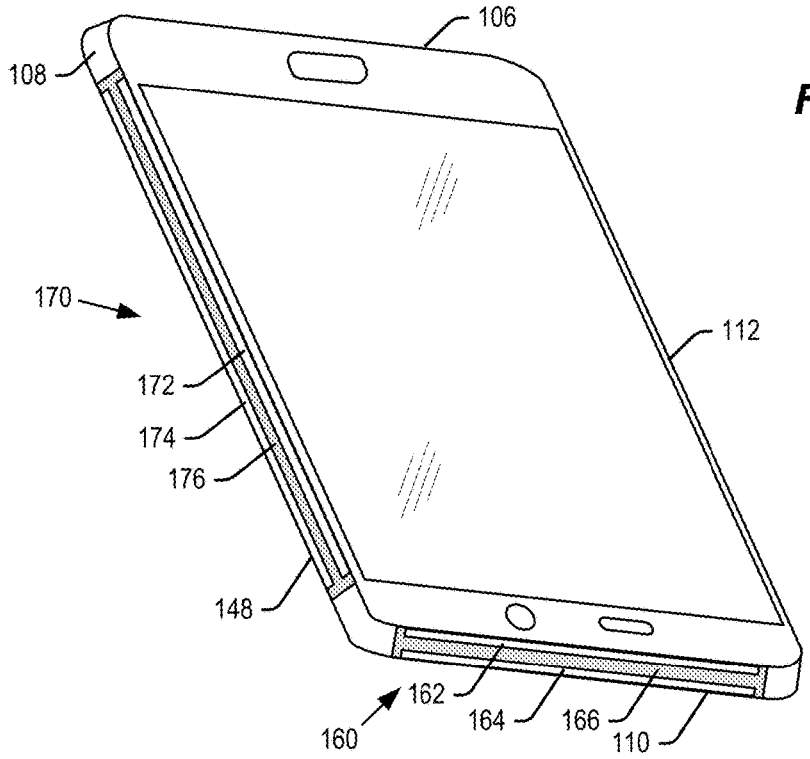
Fig. 6B

BIFURCATED MULTI-MODE RING ANTENNA FOR A WIRELESS COMMUNICATION DEVICE

FIELD OF THE INVENTION

The present technology relates to transmission and receipt of radio waves, and in particular to an antenna provided on an edge of a wireless communication device.

BACKGROUND

Wireless devices connect to wireless networks in multiple and varied frequency bands by means of antenna(s). An antenna is a medium for transmitting and receiving electromagnetic waves. Antennas for portable wireless devices such as mobile telephones may be tuned to a variety of frequencies. Currently low bands fall in the range between 698 MHz and 960 MHz and mid/high bands fall into a range between 1427 MHz and 5 GHz such as for example, 2G GSM bands (850/900/1800/1900 MHz), 3G UMTS bands 5/2/1 (850/1900/2100 MHz), Bluetooth and Wi-Fi (2.4/5 GHz) and 4GLTE bands 17/5/4/2/1/7 (700/850/1700/1900/2100/2700 MHz). Antenna volumes are decreasing as larger displays are gaining popularity.

Such antennas have evolved to address two competing interests: provide access to ever-increasing numbers of communication protocols using a multitude of frequency bands, and provide such an antenna in an ever-decreasing form factor. Perimeter ring antennas have emerged to address these competing interests. A typical ring antenna includes an external portion around an outer edge of a mobile device. Gaps may be provided in the ring to in part control the frequencies to which the antenna is tuned and counteract hand loading while being used.

Conventional ring antennas suffer from certain industrial design drawbacks. First, the full-thickness ring (i.e., full thickness of the mobile device) takes up space which could advantageously be used for other ports or components. Second, the performance of conventional full-thickness rings significantly degrade when held in a hand or against a head due to absorption of radiation by the hand or head. Third, there is a need to maximize the number of antenna in mobile devices to service additional frequency bands than are not currently serviceable with conventional ring antennas.

SUMMARY

According to one aspect of the present disclosure, there is provided an antenna for a wireless communication device including first and second major opposed surfaces and a plurality of edges extending between the first and second major surfaces, the antenna comprising: a first section of a metal conductor extending along at least a portion of a length of a first edge of the plurality of edges; a second section of the metal conductor extending along at least a portion of the section of the first edge of the plurality of edges; and a dielectric material provided between the first and second sections of the metal conductor.

Optionally, in the preceding aspect, the antenna further comprises a buried connector, buried beneath the dielectric material, on the first edge, such that the first and second sections of metal conductors appear to be isolated from each other on the first edge.

Optionally in any of the preceding aspects, the buried connector electrically connects the first and second sections of the metal conductor.

Optionally in any of the preceding aspects, an exterior of the first edge is symmetrical about a center line perpendicular to the length of the first edge.

Optionally in any of the preceding aspects, the first and second sections of metal conductor are parallel to each other.

Optionally in any of the preceding aspects, the first section of metal conductor is directly adjacent the first major surface.

Optionally in any of the preceding aspects, the second section of metal conductor is directly adjacent the second major surface.

Optionally in any of the preceding aspects, the first and second sections of metal conductor have the same width, perpendicular to the length of the first edge.

Optionally in any of the preceding aspects, the dielectric material comprises a first section of dielectric material, and the antenna further comprises: a third section of a metal conductor extending along at least a portion of a length of a second edge of the plurality of edges, the second edge being opposite the first edge; a fourth section of the metal conductor extending along at least a portion of the length of the second edge of the plurality of edges; and a second section of dielectric material provided between the third and fourth sections of the metal conductor.

Optionally in any of the preceding aspects, the dielectric material comprises a first section of dielectric material, and the antenna further comprises: a fifth section of a metal conductor extending along at least a portion of a length of a third edge of the plurality of edges, the third edge being adjacent the first edge; a sixth section of the metal conductor extending along at least a portion of the length of the third edge of the plurality of edges; and a third section of dielectric material provided between the fifth and sixth sections of the metal conductor.

Optionally, in any of the preceding aspects, a ground lead coupling the antenna to a ground plane, and one or more antenna feed connect leads coupling the antenna to antenna circuitry.

According to another aspect of the present disclosure, there is provided an antenna for a wireless communication device including first and second major opposed surfaces and a plurality of edges extending between the first and second major surfaces, the antenna comprising: a bar extending along at least a portion of a length of a first edge of the plurality of edges, the bar having a width that is less than a width of the first edge; and a dielectric material extending along at least a portion of the length of the first edge, adjacent the length of the metal conductor.

Optionally in any of the preceding aspects, the bar comprises a first bar, and the antenna further comprises a second bar extending along at least a portion of a length of a first edge of the plurality of edges, the second bar having a width that is less than a width of the first edge.

Optionally in any of the preceding aspects, the first and second bars and the dielectric material take up all of the width of the first edge.

Optionally in any of the preceding aspects, the first and second bars are the same lengths.

Optionally in any of the preceding aspects, the first and second bars are different lengths.

Optionally in any of the preceding aspects, the first and second bars are electrically coupled to each other and configured to tune the antenna to a given frequency band.

Optionally in any of the preceding aspects, an electrical connector electrically coupling the first and second bars is buried beneath an external surface of the dielectric material.

Optionally in any of the preceding aspects, the first and second bars are electrically isolated from each other.

Optionally in any of the preceding aspects, the first and second bars are configured to tune the antenna to two different frequency bands.

Optionally, in any of the preceding aspects, a ground lead coupling the antenna to a ground plane, and one or more antenna feed connect leads coupling the antenna to antenna circuitry.

According to a further aspect of the present technology, there is provided an antenna for wireless communication device including first and second major opposed surfaces and a plurality of edges extending between the first and second major surfaces, the antenna comprising: a plurality of bifurcated ring structures around an outer perimeter of the wireless communication device, a bifurcated ring structure of the plurality of bifurcated ring structures comprising: a first bar extending along a length of an edge of the plurality of edges, a second bar extending along the length of the edge of the plurality of edges, and a dielectric material separating the first and second bars along the edge; and one or more slots around the perimeter of the wireless communication device, the one or more slots dividing the plurality of bifurcated ring structures.

Optionally in any of the preceding aspects, positions of the one or more slots are selected to tune the plurality of bifurcated ring sections to a plurality of frequency bands.

Optionally in any of the preceding aspects, the first and second bars are electrically coupled to each other and configured to tune the bifurcated ring structure to a given frequency band.

Optionally in any of the preceding aspects, the first and second bars are electrically isolated from each other and configured to tune the bifurcated ring structure to different frequency bands.

Optionally, in any of the preceding aspects, one or more ground lead(s) coupling the antenna to a ground plane, and one or more antenna feed connect leads coupling the antenna to antenna circuitry.

BRIEF DESCRIPTION OF THE DRAWINGS

FIG. 6A is a perspective view of a portable wireless communication device including a bifurcated ring structure along a bottom edge and right edge of the device according to the present technology.

FIG. 6B is a perspective view of a portable wireless communication device including a bifurcated ring structure along a top edge and left edge of the device according to the present technology.

DETAILED DESCRIPTION

Figure 1:
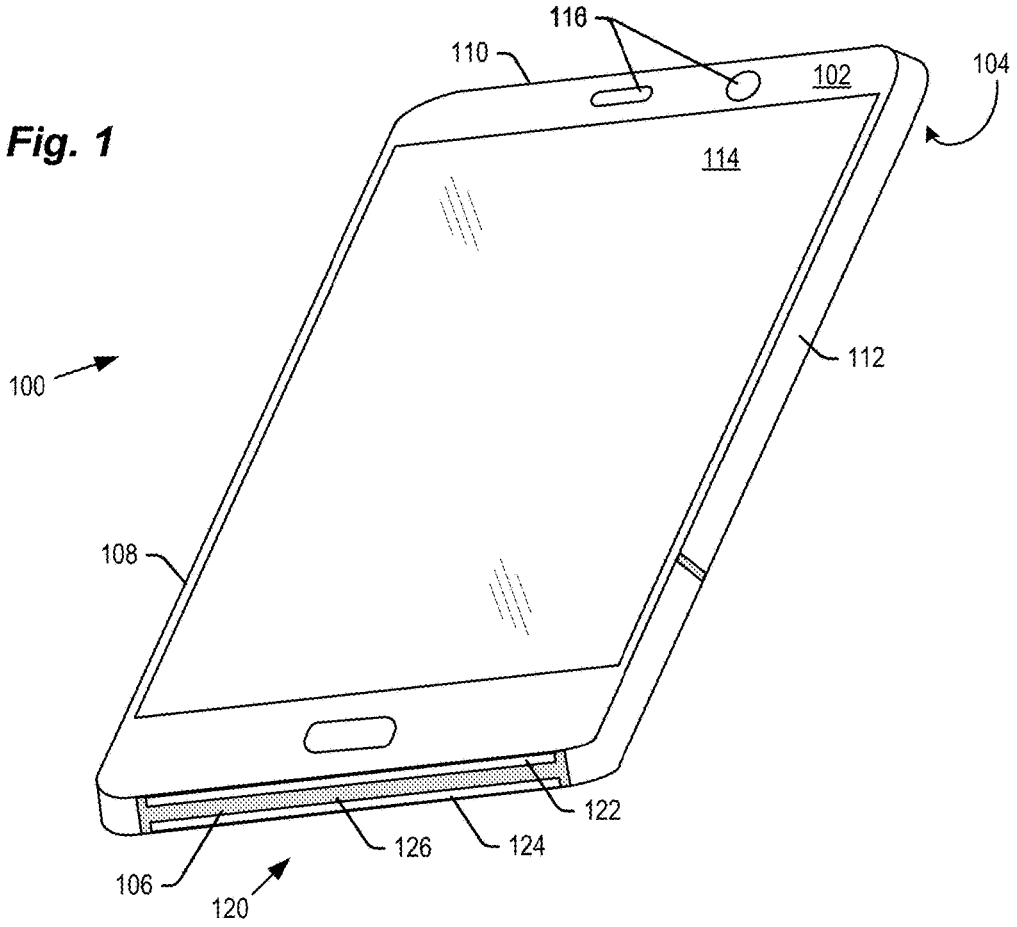
FIG. 1 is a perspective view of a portable wireless communication device including a bifurcated ring antenna according to embodiments of the present technology.

The present technology, roughly described, relates to a multiband antenna for wireless mobile communication devices such as cellular telephones. The antenna may include a bifurcated ring structure along one, two, three or all four edges of the device. The ring structure may include bifurcated metal conductors, or bars, extending along the length of the one or more edges. A first of the bars positioned on the one or more edges may be adjacent a first major planar surface of the device, and a second of the bars may be positioned on the one or more edges adjacent a second major planar surface. A dielectric material may be positioned on the one or more edges between the pair of bifurcated bars. In embodiments, the pair of bifurcated bars on an edge may be electrically coupled to each other with a connector, buried beneath the dielectric material, so as to provide a symmetrical appearance of the bifurcated bars on the edge.

As noted, the bifurcated ring antenna of the present technology may be used on cellular telephones, but may also be used on a wide variety of other wireless communication devices. The present technology may be implemented as a multiband antenna, such as a wideband/broadband antenna design providing low frequency band coverage from 690 MHz-960 MHz, and Mid/High frequency band coverage from 1400 MHz to 2700 MHz over various communication protocols such as: GSM(2G)/UMTS(3G)/LTE(4G)/Wifi depending on the mode of antenna optimization and tuning. While specific frequency bands are listed above as they are currently used for wireless communications, embodiments are not limited to these bands, and any other bands that are implemented by these or other standards or devices are within the scope of various embodiments.

It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

The terms "top" and "bottom," "upper" and "lower" and "vertical" and "horizontal" as may be used herein are by way of example and illustrative purposes only, and are not meant to limit the description of the invention inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±0.25%.

FIG. 1 illustrates an embodiment of a handheld wireless communication device 100. The wireless communication device 100 may comprise an outer housing defined by a pair of opposed major planar surfaces 102 and 104, and a plurality of edges 106, 108, 110 and 112 extending between the major planar surfaces 102 and 104 and defining a perimeter of the device 100. One of the major planar surfaces, for example surface 102, may include a user interface (UI) 114 for user interaction with the device 100, as well as UI components 116 as may be known in the art. In the example shown, the device has a rectangular footprint with rounded corners between adjacent edges. It is understood that the device need not be rectangular and need not include rounded corners in further embodiments.

Figure 2:
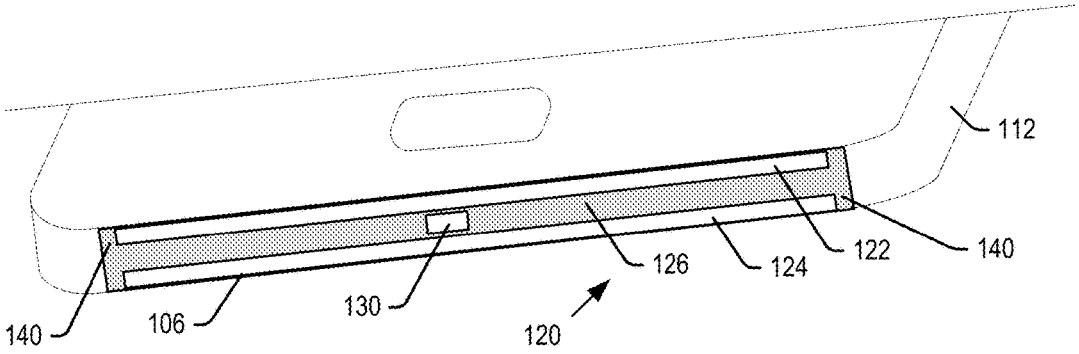
FIG. 2 is an enlarged perspective view of a portable wireless communication device showing greater detail of a bifurcated ring antenna according to embodiments of the present technology.

The device 100 may further include an antenna including an external portion and an internal portion. The external portion may be in the form of a bifurcated ring structure around the perimeter of the device 100, on one or more of the edges 106, 108, 110 and 112. The illustration of FIG. 1 and the enlarged view of FIG. 2 show a bifurcated ring structure 120 provided on edge 106. As shown below, one or more of the remaining edges may additionally or alternatively include a bifurcated ring structure. The external portion of the antenna is referred to herein as a bifurcated ring structure, even though it may be provided on less than all of the edges 106, 108, 110 and 112 in embodiments.

The bifurcated ring structure 120 on the one or more edges may include first and second elongate conductors 122, 124, referred to herein as bars 122, 124. The bars 122, 124 may be formed of any of a variety of electrically conductive material, including but not limited to copper, aluminum, silver, gold, iron, platinum, tin, nickel, titanium, tungsten, stainless steel and alloys thereof. In further embodiments, the bars 122, 124 may be printed onto a polyimide film, using flexible printed circuit technology, mounted on a rigid medium including plastic or glass.

The first bar 122 may be positioned on an edge 106, 108, 110 and/or 112, abutting or directly adjacent the major planar surface 102, and the second bar 124 may be positioned on the edge, abutting or directly adjacent the second major planar surface 104. The bars may be slightly spaced from the major planar surfaces 102, 104 in further embodiments. The bars 122, 124 may have a straight length along the length of an edge 106-112, parallel to the top and bottom of the edge and parallel to each other. In further embodiments, one or both of the bars 122, 124 may be wider at one end than the other (so as not to be parallel to the top/bottom of the edge). In embodiments, the bars 122, 124 may have the same width, which may for example be 1 to 3 mm. However, the bars 122, 124 may be any width on an edge provided a space exists between the bars 122, 124. In further embodiments, one bar may be wider than the other.

The bars 122, 124 on the one or more edges may be spaced from each other by a dielectric material 126. In embodiments, dielectric material may be plastic, glass, fiber glass, ceramic, rubber, various polymers and other electrically insulative materials. The dielectric material 126 may extend between and into direct contact with the bars 122, 124 so that the bars 122, 124 and material 126 together take up the full width of an edge 106-112. In embodiments where the bars 122, 124 are slightly spaced from the major planar surfaces 102, 104, the dielectric material 126 may surround the bars along top and bottom edges of the bars.

The spacing of the bars 122, 124 may allow one or more input/output (I/O) components 130 to be located within the dielectric material 126 between the bars 122, 124. The I/O component 130 may be a port, such as a USB or other port. The I/O component may be an I/O device, such as a speaker, microphone or input button. The bifurcated configuration of the bars 122, 124 allow those portions of the antenna to be provided along an entire edge, while still including one or more I/O components 130.

Figure 3:
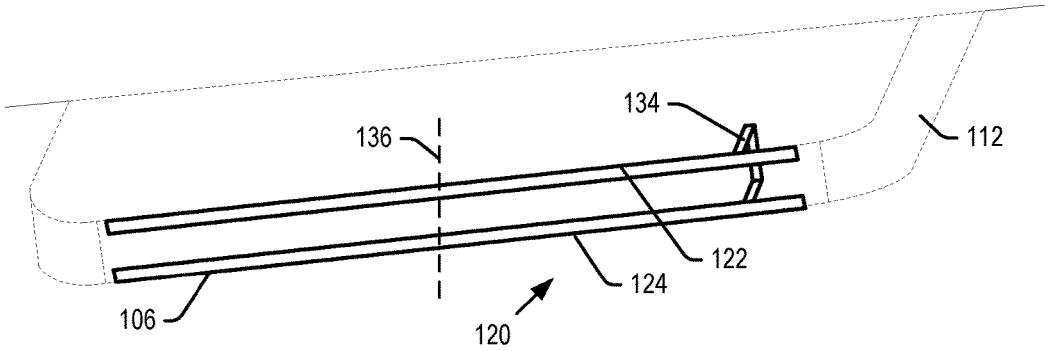
FIG. 3 illustrates an enlarged perspective view of a portion of a bifurcated ring antenna showing a buried connector electrically connecting the elongate bars according to embodiments of the present technology.
Figure 4:
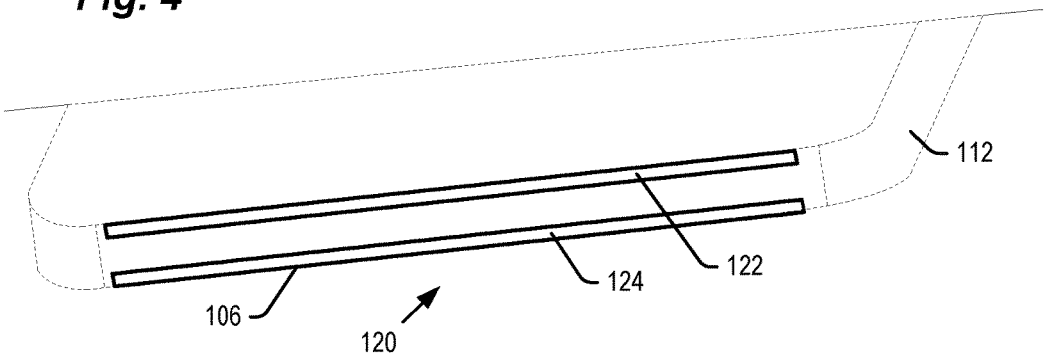
FIG. 4 illustrates an enlarged perspective view of a portion of a bifurcated ring antenna having no buried connector to electrically isolate the elongate bars according to embodiments of the present technology.

In order to provide the desired frequency response, the bars 122, 124 may be electrically coupled to each other. As shown in FIG. 3, this may be accomplished with an electrical connector 134, referred to herein as a buried electrical connector 134. The connector 134 is so named as it is buried beneath the external surface of the dielectric material 126. Burying the buried connector 134 beneath the surface of the dielectric material allows electrical connection of the bars 122, 124 to each other, while still providing a symmetrical appearance of the bars 122, 124 on an edge (i.e., symmetrical about centerline 136). Thus, on the external surface, the bars 122, 124 appear to be physically and electrically isolated from each other, but they may be connected by buried connector 134. As shown in FIG. 4, the buried connector 134 may be omitted in further embodiments. In such an embodiment, the bars 122, 124 are in fact physically and electrically isolated from each other. In such an embodiment, one of the bars may be connected to the internal portion of the antenna, while the other portion may be floating, or electrically isolated.

In embodiments, the bars 122, 124 may be stamped from a sheet and may for example be placed in mold into which the dielectric material is injected in molten form to ensure a clean, tight fit of the bars with the dielectric material. In embodiments where the bars 122, 124 printed on a flexible strip, the flexible strip may be mounted within a mold which is then filled with the dielectric material. Where a buried connector is included, it may be affixed to the bars 122, 124 after removal from the mold. Alternatively, the bars 122, 124 and dielectric material 126 may be formed separately and then assembled together at one or more edges. In embodiments, the dielectric material may be thicker (i.e., in a direction perpendicular to the edges 106-112) than the bars 122, 124, but they may each be the same thickness in further embodiments.

Referring again to FIG. 2, the bifurcated ring structure may terminate along one or more of the edges 106-112 at a slot 140 extending the full width of the one or more edges 106-112. In the example shown in FIG. 2, the edge 106 includes a pair of slots 140, at opposed ends of the edge 106. The slot may be filled with the dielectric material 126. Thus, the dielectric material 126 on the edge 106 shown in FIG. 2 has an "H" shape. An edge 106, 108, 110, 112 may have one or more slots (such as two or three slots), or it may have no slot. Where an edge has no slot, the metal bars 122, 124 may extend along the entire length of the edge. A slot 140 may alternatively or additionally be provided at a rounded corner between a pair of adjacent edges 106, 108, 110, 112.

The slots 140 may be provided at positions to control the frequency responses of the bifurcated ring structures 120 in the one or more edges. Slot locations may be moved around the bifurcated ring structure 120 in order to tune the antenna to different frequency bands, and also counteract user hand grip, as explained below. In embodiments, slots 140 may be omitted, in which case, the bifurcated ring structure may form a pair of complete, uninterrupted rings around the perimeter of mobile communication device 100. Where one or more slots 140 are provided, the bifurcated ring structures may form a ring with sections that are separated from each other at the one or more slots 140. In embodiments, a slot may extend across the entire width of an edge, so that all bars 122, 124 defined by the slots are the same length and align with each other around the perimeter of the device 100. In further embodiments, a slot may extend only halfway across a width of an edge so as to interrupt only one of the bars 122, 124. In such an embodiment, a given bifurcated ring structure 120 may be comprised of bars 122 and 124 having different lengths.

The slots 140 may have different shapes (e.g., circular, elliptical, or rectangular), and may have a width to provide a sufficient gap suitable for RF signal radiation. In one embodiment, the width of slots 140 may be between 1 mm and 5 mm, but the width of a slot 140 may be greater or lesser than that in further embodiments.

Figure 5:
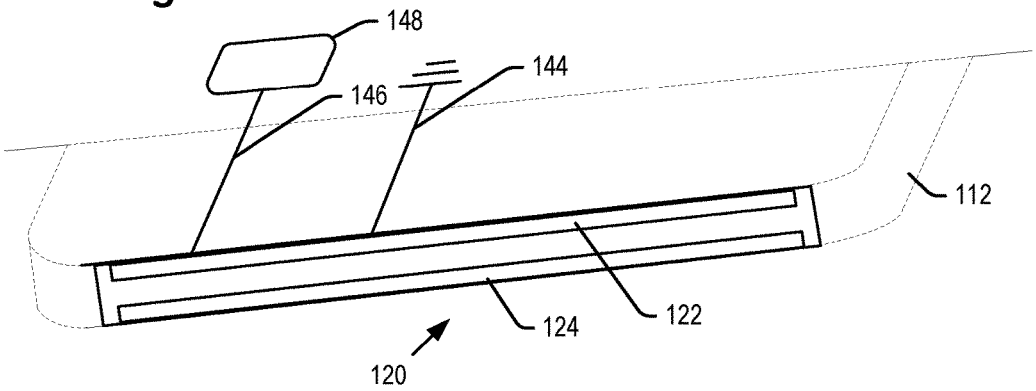
FIG. 5 is an enlarged perspective view of a portion of a bifurcated ring antenna showing internal and external portions of the antenna connected to a PCB according to embodiments of the present technology.

FIGS. 1-4 illustrate the external portions comprised of the bifurcated ring structures of the antenna of the present technology. The internal portions of the antenna will now be described with reference to FIG. 5. The internal portions of the antenna may include a ground lead 144 connected at one end to the bifurcated ring structure 120, and at the other end to a grounding element for antenna circuitry 148, such as for example to a ground plane of a PCB (not show) within device 100 coupled with the antenna circuitry. The internal portions of the antenna may further include one or more antenna feed connect leads 146 connected at one end to the bifurcated ring structure 120 and at the other end to the antenna circuitry 148. The antenna circuitry is described in greater detail below with respect to FIG. 11. The internal portion of the antenna may include other components known in the art.

FIGS. 6A and 6B show different bifurcated ring structures formed in different edges 106, 108, 110 and 112 of the wireless communication device 100. In particular, in addition to the bifurcated ring structure 120 in edge 106 described above, FIG. 6A further shows a bifurcated ring structure 150 in edge 112 comprising first and second bars 152, 154 and dielectric material 156. FIG. 6B shows a bifurcated ring structure 160 in edge 110 comprising first and second bars 162, 164 and dielectric material 166, and a bifurcated ring structure 170 in edge 108 comprising first and second bars 172, 174 and dielectric material 176. Each of bifurcated ring structures 150, 160 and 170 may be similar to the bifurcated ring structure 120 described above. It is understood that one or more of the edges 106, 108, 110 and 112 may include a bifurcated ring structure, while the remaining sides include a conventional (full-width) ring structure or no ring structure.

Figure 7A:
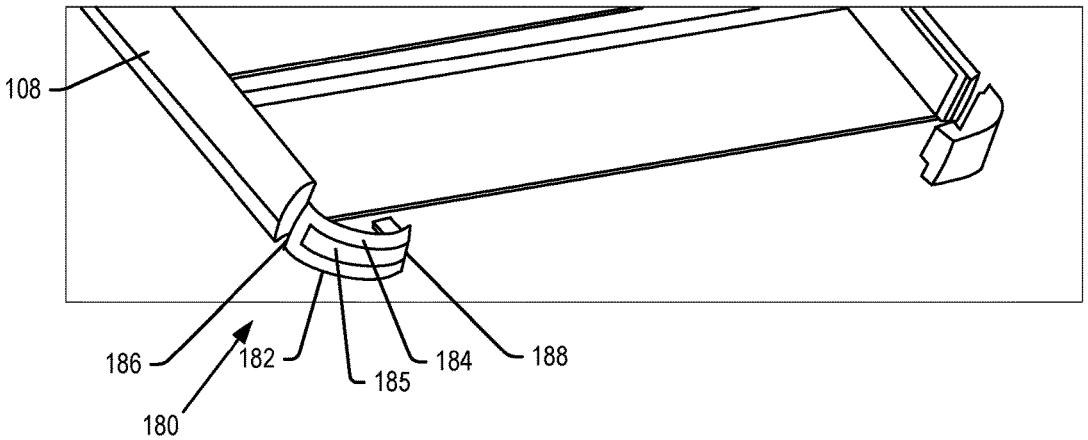
FIG. 7A is a perspective view providing detail of the corners of the portable wireless communication device including a bifurcated ring structure according to the present technology.
Figure 7B:
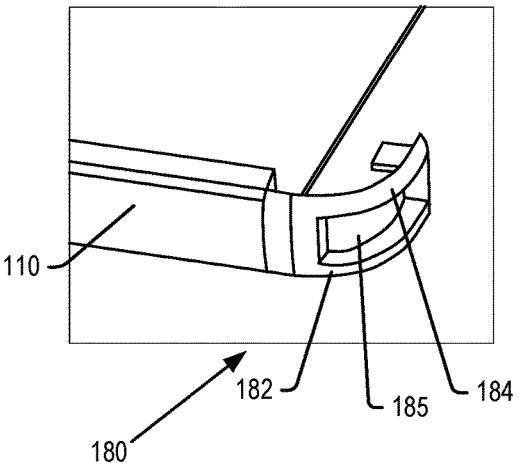
FIGS. 7B and 7C are alternative embodiments of a corner section of the portable wireless communication device including a bifurcated ring structure according to the present technology.
Figure 7C:
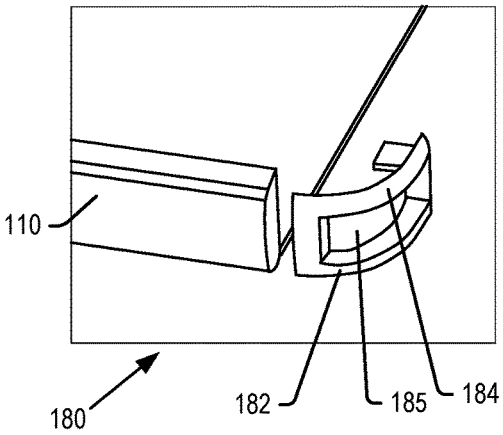

As noted above, the corners between the edges 106, 108, 110 and 112 may also include bifurcated ring structures. FIGS. 7A-7C provide greater details of corner sections 180 of between the edges 106, 108, 110 and/or 112. As shown in FIG. 7A, each corner section may include a bifurcated ring comprising bars 182, 184 isolated from each other by dielectric material 185, as described above. The bars 182, 184 may be connected to each other at a first end 186 on an exterior surface of the wireless communication device 100. The bars 182, 184 may be open at a second, opposed end 188, or they may be connected with a buried connector, buried beneath the dielectric material 185 as described above. The corner section 180 may be electrically connected to one or both of the adjacent edges 106, 108, 110 and/or 112, as shown in FIG. 7B. Alternatively, the corner section 180 may be electrically isolated from one or both of the adjacent edges 106, 108, 110 and/or 112, as shown in FIG. 7C.

Figure 8:
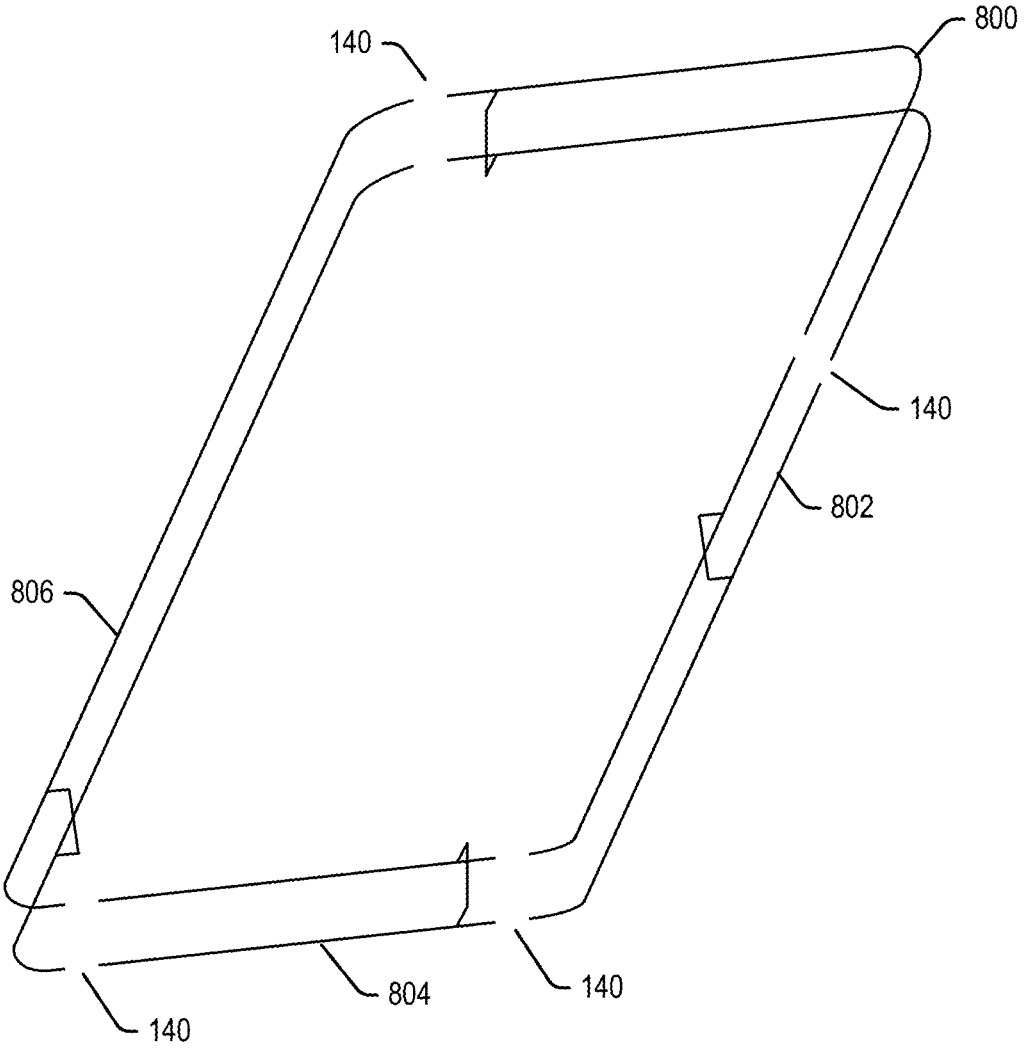
FIG. 8 is a perspective view of a pair of bifurcated rings for use around an edge of a mobile communication device.

FIG. 8 shows an example of bifurcated ring structures 800, 802, 804 and 806 extending around the entire perimeter of the wireless communication device 100. The embodiment shown includes four slots 140, thus dividing the ring into four separate rings structures which can be used as multiple antennae. It is understood that there may be more or less slots 140, to define more or less bifurcated ring structures depending on the need regarding wireless connectivity and protocol. Additionally, any combination of edges and corners may include a bifurcated ring structure, while the remaining edges and corners include a conventional (full-width) ring structure or no ring structure.

In the embodiments described above, each ring structure includes a pair of bifurcated bars 120 electrically coupled together to create wide/narrow band antennae covering multiple low/mid/high frequency bands. There is currently a need to increase the number of antennas and bands served by a mobile computing device. For example, multiple-input and multiple-output, or MIMO, is a current technology for multiplying the capacity of a radio link using multiple transmit and receive antennas to exploit multipath propagation and in turn generate higher throughput. Thus, in accordance with an alternative embodiment of the present technology, one or more bifurcated ring structures around the perimeter of the computing device 100 may include bars that are not electrically coupled to each other. Instead, the bars of a given bifurcated ring structure may each have a separate connection to the antenna circuitry 154 so that each may be tuned to a different band. Thus, for example, the four separate bifurcated ring structures 800, 802, 804 and 806 may receive/transmit at eight or more frequency bands. As noted above, slots 140 need not be full-thickness, so that one bar of a bifurcated ring structure in this embodiment may be longer than the other bar.

Figure 9:
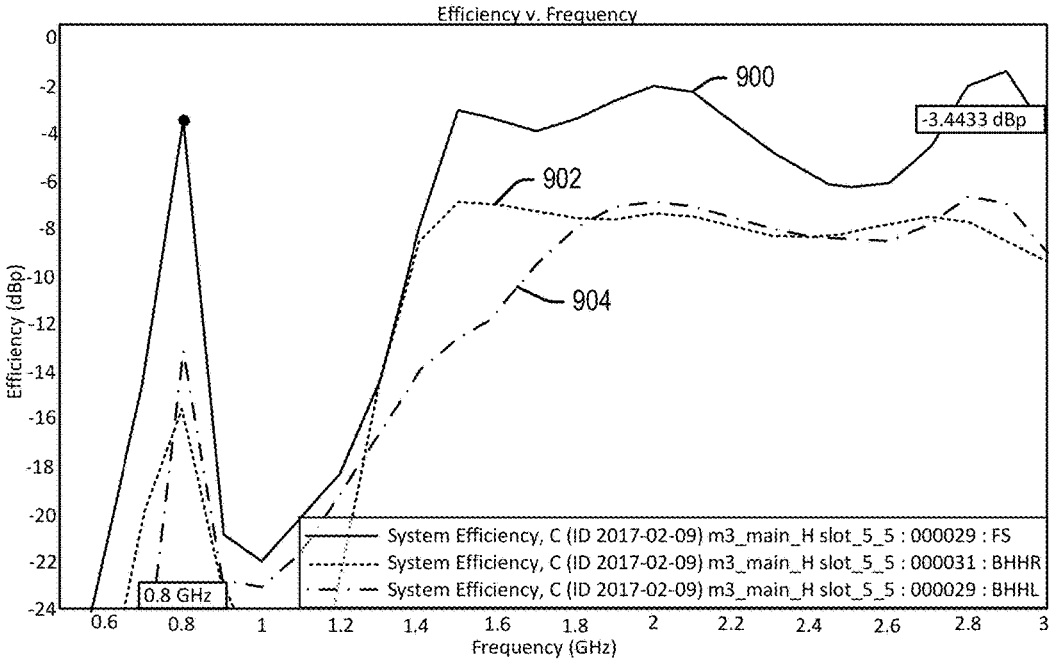
FIG. 9 is a graph of antenna efficiency for an embodiment of the bifurcated ring antenna.
Figure 10:
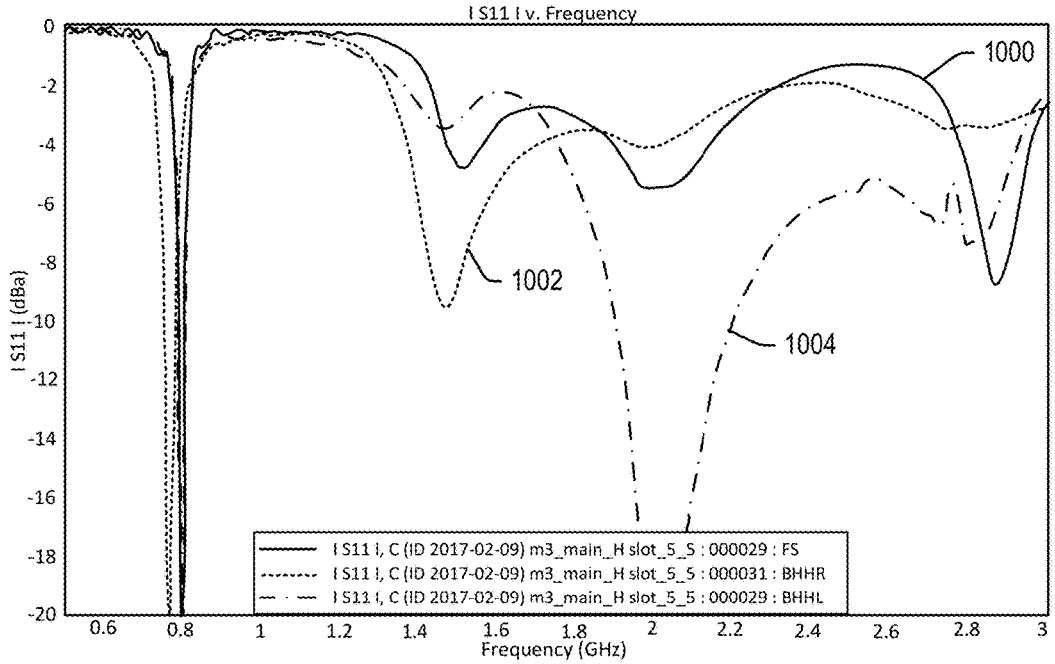
FIG. 10 is a graph of antenna loss for an embodiment of the bifurcated ring antenna.

FIGS. 9 and 10 illustrate the antenna efficiency and matching/return loss for an antenna configured for low band (e.g., about 800 MHz) and mid/high bands (1400-2700 MHz) transmission in accordance with one embodiment of the present technology. FIG. 9 shows the free space antenna efficiency 900, versus the antenna efficiency 902 for beside the head and hand (right hand) and the antenna efficiency 904 for beside the head and hand (left hand). FIG. 10 shows the free space matching/return loss 1000, versus the antenna matching/return loss 1002 for beside the head and hand (right hand) and the antenna matching/return loss 1004 for beside the head and hand (left hand). As shown, the bifurcated ring structure antenna according to embodiments of the present technology meets performance specifications for current mobile phone and other wireless communication devices.

Figure 11:
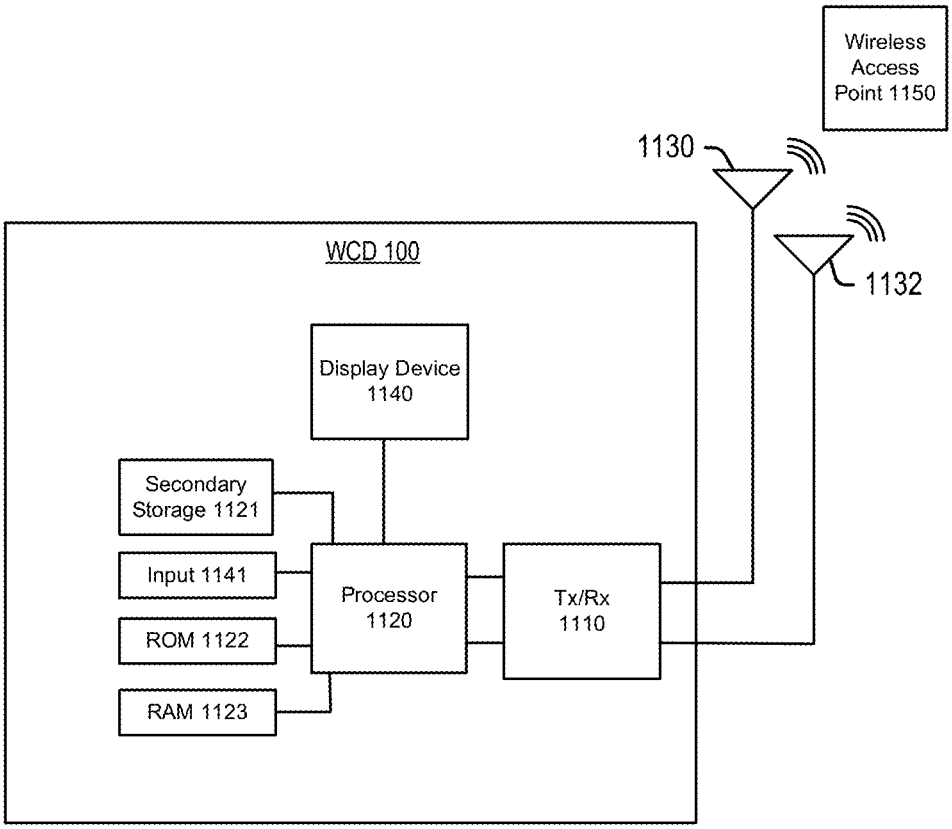
FIG. 11 is a block diagram of a mobile communication device according to embodiments of the present technology.

FIG. 11 illustrates a schematic diagram of an embodiment of a mobile communication device (MDC) 100. Device 100 may comprise any of a variety of two-way wireless communication devices having voice and data communication capabilities. The device 100 generally has the capability to communicate with other devices and computer systems on the Internet. Depending on the functionality provided, the device 100 may be referred to as a data messaging device, a two-way pager, a wireless e-mail device, a cellular telephone with data messaging capabilities, a wireless Internet appliance, a wireless device, a smart phone, a mobile device, and/or a data communication device, as examples.

Device 100 may comprise a processor 1120 (which may be referred to as a central processor unit or CPU) that is in communication with memory devices including secondary storage 1121, read only memory (ROM) 1122, and random access memory (RAM) 1123. The processor 1120 may be implemented as one or more general-purpose processors running software on one or more cores (e.g., a multi-core processor), or may be part of one or more ASICs and/or digital signal processors (DSPs).

The secondary storage 1121 may be comprised of one or more solid state drives, disk drives, and/or other memory types and is used for non-volatile storage of data and as an over-flow data storage device if RAM 1123 is not large enough to hold all working data. Secondary storage 1121 may be used to store programs that are loaded into RAM 1123 when such programs are selected for execution. The ROM 1122 may be used to store instructions and perhaps data that are read during program execution. ROM 1122 may be a non-volatile memory device may have a small memory capacity relative to the larger memory capacity of secondary storage 1121. The RAM 1123 may be used to store volatile data and perhaps to store instructions.

The device 100 may communicate data (e.g., packets) wirelessly with a network via a network access point 1150. As such, the device 100 may comprise a transceiver Tx/Rx 1110. The Tx/Rx may be, or may be coupled to, the antenna circuitry 154 described above. A baseband chipset for operating with Tx/Rx 1110 may be embodied as part of the processor 1120 or as one or more separate components. Tx/Rx 1110 may be configured for receiving data (e.g. wireless packets or frames) from other components. The Tx/Rx 1110 may be coupled to the processor 1120, which may be configured to process the data and determine to which components the data is to be sent. The Tx/Rx 1110 may also be configured for transmitting data to other components, for example by using protocols such as Institute of Electrical and Electronics Engineers (IEEE) 802.11, IEEE 802.16, 3rd Generation Partnership Project (3GPP), Global System for Mobile Communications (GSM), protocols mentioned above, or similar wireless protocols. The Tx/Rx 1110 may be coupled to a plurality of antennas 1130 and 1132 (and possibly others, not explicitly shown), which may be configured to receive and transmit wireless radio frequency (RF) signals. Antennas 1130 and 1132 may be configured to include external bifurcated ring structures as described above.

The device 100 may also comprise a device display 1140 coupled to the processor 1120, that displays output to a user. The device display 1140 may be equipped with a touch sensor based on resistive and/or capacitive technologies. The device 100 may further comprise an input device 1141 coupled to the processor 1120, which may allow the user to input commands to the device 100. In the case that the display device 1140 comprises a touch sensor, the display device 1140 may also be considered the input device 1141. In addition to and/or in the alternative, an input device 1141 may comprise a mouse, microphone, tilt sensor, accelerometer, scanner, camera, trackball, built-in keyboard, external keyboard, and/or any other device that a user may employ to interact with the device 100.

It is understood that by programming and/or loading executable instructions onto the device 100, at least one of the processor 1120, the ROM 1122, the RAM 1123, secondary storage 1121, and Tx/Rx 1110 are changed, transforming the device 100 in part into a particular machine or apparatus, e.g., a multi-antenna mobile device, having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an ASIC, because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

It is understood that the present subject matter may be embodied in many different forms and should not be construed as being limited to the embodiments set forth herein. Rather, these embodiments are provided so that this subject matter will be thorough and complete and will fully convey the disclosure to those skilled in the art. Indeed, the subject matter is intended to cover alternatives, modifications and equivalents of these embodiments, which are included within the scope and spirit of the subject matter as defined by the appended claims. Furthermore, in the following detailed description of the present subject matter, numerous specific details are set forth in order to provide a thorough understanding of the present subject matter. However, it will be clear to those of ordinary skill in the art that the present subject matter may be practiced without such specific details.

The computer-readable non-transitory media includes all types of computer readable media, including magnetic storage media, optical storage media, and solid state storage media and specifically excludes signals. It should be understood that the software can be installed in and sold with the device. Alternatively the software can be obtained and loaded into the device, including obtaining the software via a disc medium or from any manner of network or distribution system, including, for example, from a server owned by the software creator or from a server not owned but used by the software creator. The software can be stored on a server for distribution over the Internet, for example.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An antenna for a wireless communications device including first and second major opposed surfaces and a plurality of edges extending between the first and second major surfaces, the antenna comprising:

a first section of a metal conductor extending along at least a first portion of a length of a first edge of the plurality of edges;

a second section of the metal conductor extending along at least a second portion of the length of the first edge of the plurality of edges; and a dielectric material provided between the first and second sections of the metal conductor, and physically isolating the first and second sections of metal conductor from each other on a surface of the first edge.

2. The antenna of claim 1, further comprising a buried connector, buried beneath the dielectric material, on the first edge, wherein the buried connector electrically connects the first and second sections of the metal conductor.

3. The antenna of claim 2, wherein an exterior of the first edge is symmetrical about a center line perpendicular to the length of the first edge.

4. The antenna of claim 1, further comprising of one or more ground lead(s) coupling the antenna to a ground plane, and one or more antenna feed connect leads coupling the antenna to antenna circuitry.

5. The antenna of claim 1, wherein the first and second sections of metal conductor are parallel to each other.

6. The antenna of claim 1, wherein the first section of metal conductor is directly adjacent to the first major surface.

7. The antenna of claim 6, wherein the second section of metal conductor is directly adjacent to the second major surface.

8. The antenna of claim 1, wherein the first and second sections of metal conductor have the same width, in a direction perpendicular to the first edge.

9. The antenna of claim 1, wherein the dielectric material comprises a first section of dielectric material, the antenna further comprising:

a third section of a metal conductor extending along at least a first portion of a length of a second edge of the plurality of edges, the second edge being opposite the first edge;

a fourth section of the metal conductor extending along at least a second portion of the length of the second edge of the plurality of edges; and a second section of dielectric material provided between the third and fourth sections of the metal conductor.

10. The antenna of claim 9, the antenna further comprising:

a fifth section of a metal conductor extending along at least a first portion of a length of a third edge of the plurality of edges, the third edge being adjacent the first edge;

a sixth section of the metal conductor extending along at least a second portion of the length of the third edge of the plurality of edges; and a third section of dielectric material provided between the fifth and sixth sections of the metal conductor.

11. An antenna for a wireless communications device including first and second major opposed surfaces and a plurality of edges extending between the first and second major surfaces, the antenna comprising:

a bar extending along at least a first portion of a length of a first edge of the plurality of edges, the bar having a width that is less than a width of the first edge; and a dielectric material extending along at least a second portion of the length of the first edge, adjacent the length of the bar.

12. The antenna of claim 11, further comprising of one or more ground lead(s) coupling the antenna to a ground plane, and one or more antenna feed connect leads coupling the antenna to antenna circuitry.

13. The antenna of claim 11, wherein the bar comprises a first bar, the antenna further comprising a second bar extending along at least a third portion of the length of the first edge of the plurality of edges, the second bar having a width that is less than a width of the first edge.

14. The antenna of claim 13, wherein the first and second bars and the dielectric material take up all of the width of the first edge.

15. The antenna of claim 13, wherein the first and second bars are the same lengths.

16. The antenna of claim 13, wherein the first and second bars are different lengths.

17. The antenna of claim 13, wherein the first and second bars are electrically coupled to each other and configured to tune the antenna to a combination of frequency bands.

18. The antenna of claim 13, wherein an electrical connector electrically coupling the first and second bars is buried beneath an external surface of the dielectric material.

19. The antenna of claim 13, wherein the first and second bars are electrically isolated from each other.

20. The antenna of claim 19, wherein the first and second bars are configured to tune the antenna to two different frequency bands.

21. An antenna for a wireless communications device including first and second major opposed surfaces and a plurality of edges extending between the first and second major surfaces, the antenna comprising:

a plurality of bifurcated ring structures around an outer perimeter of the wireless communications device, a bifurcated ring structure of the plurality of bifurcated ring structures comprising:

a first bar extending along a length of an edge of the plurality of edges, a second bar extending along the length of the edge of the plurality of edges, and a dielectric material separating the first and second bars along the edge; and one or more slots around the perimeter of the wireless communications device, the one or more slots dividing the plurality of bifurcated ring structures.

22. The antenna of claim 21, further comprising of one or more ground lead(s) coupling the antenna to a ground plane, and one or more antenna feed connect leads coupling the antenna to antenna circuitry.

23. The antenna of claim 21, wherein the first and second bars are electrically isolated from each other and configured to tune the bifurcated ring structure to different frequency bands.

24. The antenna of claim 21, wherein the first and second bars are electrically coupled to each other and configured to tune the bifurcated ring structure to a given frequency band.

25. A wireless communications device, comprising:

first and second major opposed surfaces;

a plurality of edges extending between the first and second major opposed surfaces; and an antenna, comprising:

a first metal conductor extending along at least a first portion of a length of a first edge of the plurality of edges;

a second metal conductor separated from the first metal conductor and extending along at least a second portion of the length of the first edge of the plurality of edges; and a dielectric material provided between the first and second metal conductors, and physically isolating the first and second metal conductors from each other on a surface of the first edge.

26. The antenna of claim 25, further comprising a buried connector, buried beneath the dielectric material, on the first edge, wherein the buried connector electrically connects the first and second metal conductors.

27. The antenna of claim 25, wherein the first and second metal conductors are parallel to each other.

28. A wireless communications device comprising:

first and second major opposed surfaces;

a plurality of edges extending between the first and second major opposed surfaces; and an antenna system, the antenna system comprising:

a bar formed of an electrically conductive material and extending along at least a first portion of a length of a first edge of the plurality of edges, the bar having a width that is less than a width of the first edge;

a dielectric material extending along at least a second portion of the length of the first edge, adjacent the length of the bar; and an antenna circuitry coupled to the bar.

29. The device of claim 28, wherein the bar comprises a first bar, the antenna further comprising a second bar extending along at least a third portion of the length of the first edge of the plurality of edges, the second bar having a width that is less than a width of the first edge.

30. The device of claim 29, wherein the first and second bars and the dielectric material take up all of the width of the first edge.

31. The device of claim 29, wherein an electrical connector electrically coupling the first and second bars is buried beneath an external surface of the dielectric material.

32. A wireless communications device comprising:

first and second major opposed surfaces;

a plurality of edges extending between the first and second major opposed surfaces; and an antenna system, the antenna system comprising:

an antenna circuitry;

a plurality of bifurcated ring structures around an outer perimeter of the wireless communications device, a bifurcated ring structure of the plurality of bifurcated ring structures comprising:

a first bar and second bar coupled to the antenna circuitry and formed of an electrically conductive material, the first bar extending along a length of an edge of the plurality of edges, the second bar extending along the length of the edge of the plurality of edges;

a dielectric material separating the first and second bars along the edge; and one or more slots around the perimeter of the wireless communications device, the one or more slots dividing the plurality of bifurcated ring structures.

33. The device of claim 32, further comprising one or more ground leads coupling the antenna to a ground plane, and one or more antenna feed connect leads coupling the antenna to antenna circuitry.

34. The device of claim 32, wherein the first and second bars are electrically isolated from each other, the first and second bars corresponding to respective different frequency bands of the wireless communications device.

35. The device of claim 32, wherein positions of the one or more slots are selected to tune the plurality of bifurcated ring sections to a plurality of frequency bands.

* * * * *